United States Patent [19]

Voinovich et al.

[11] Patent Number: 4,905,999

[45] Date of Patent: Mar. 6, 1990

[54] PRACTICE GOLF TEE

[76] Inventors: Steven M. Voinovich, 230 N. 70th St., Milwaukee, Wis. 53213; Michael J. Messina, 8712 W. Mitchell St., West Allis, Wis. 53214

[21] Appl. No.: 94,138

[22] Filed: Nov. 17, 1987

[51] Int. Cl.[4] ..... A63B 57/00

[52] U.S. Cl. ..... 273/32.5; 273/33

[58] Field of Search ..... 273/33, 195, 32 B, 32.5, 273/202, 207, 208, 209, 212

[56] References Cited

U.S. PATENT DOCUMENTS 2,470,817 5/1949 Hendricks ..... 273/207

FOREIGN PATENT DOCUMENTS 781287 5/1935 France ..... 273/207

238599 8/1925 United Kingdom ..... 273/112

*Primary Examiner*—T. Brown

*Attorney, Agent, or Firm*—Michael, Best & Friedrich

[57] ABSTRACT

A practice golf tee includes a flexible tubular section, adapted to support a golf ball, and a threaded anchor section insertable into the ground and arranged to support the tubular flexible section perpendicularly relative to the ground. A detachable, user-actuable handle is provided for selectively inserting the practice golf tee into, and removing the practice golf tee from, the ground. Because the anchor section securely anchors the flexible tubular section to the ground, the practice golf tee need not be reinserted into the ground or repositioned before each practice drive. Thus, the practice golf tee is well suited for permitting golf practice from the grassy areas of a driving range or other practice site.

12 Claims, 1 Drawing Sheet

PRACTICE GOLF TEE

BACKGROUND OF THE INVENTION

This invention relates generally to golf apparatus and, more particularly, to a golf tee which is particularly well suited for use as a practice tee.

Practice for the game of golf frequently takes place at a golf driving range. Conventional driving ranges typically provide two types of practice tee or hitting areas. The first type of hitting area includes an artificial turf mat having a permanently installed tubular tee extension. The golfer stands on the mat and hits the practice golf balls from the tubular tee. One particular drawback of this arrangement is that the footing offered by the artificial turf mat does not duplicate the actual footing the golfer will encounter in playing a round of golf.

The other type of hitting area typically provided at a driving range is a grassy area which will provide the type of footing usually encountered on an actual golf course. One of the particular drawbacks of such natural grass hitting areas is that, when a conventional tee is used to support the golf ball, the tee will more likely than be knocked out of position at best, or lost or broken at worst, during each practice drive. Tees which are not lost or broken must be reinserted into the ground, and time, which could otherwise be devoted to actual golf practice, is lost.

In view of the foregoing, it is a general object of the present invention to provide a practice golf tee which can be used in grassy areas and which provides the teeing convenience usually associated with artificial turf mats.

It is a more specific object of the present invention to provide a practice golf tee which can be used in a grassy area without requiring repositioning of the tee following each practice swing.

SUMMARY OF THE INVENTION

The invention provides a golf tee apparatus which, although suitable for use in actual play, is particularly well adapted for use in connection with the practice of golf. In particular, the invention facilitates practice in a grassy area of a driving range and offers the convenience of a flexible tee which will not be lost or broken by a swinging golf club and which need not be reinserted into the ground before each swing.

The invention is directed to a golf tee including an elongate flexible member, having one end adapted to support a golf ball, and an anchor adapted to be inserted into the ground for supporting the flexible member in substantially perpendicular orientation relative to the ground with the one end uppermost.

The invention is also directed to a golf tee which includes two sections. One section is an elongate tubular member similar to the tubular member usually found in connection with artificial turf driving range mats. The other section is elongate and is adapted to be coupled to one end of the tubular member in substantally co-linear alignment with the tubular member. This other section is insertable into the ground and includes means for holding the entire tee in the ground after it is inserted and for resisting forces applied to the tee during the hitting stroke tending to remove the tee from the ground.

In one preferred embodiment, the other section includes an external thread configuration which permits the tee to be screwed into the ground with a twisting motion. The invention also contemplates a convenient means for engaging the tee with a suitable tool to enable the tee to be twisted into or out of the ground.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, in the several figures of which like reference numerals identify like elements, and in which:

DESCRIPTION OF THE PREFERRED EMBODIMENT

Figure 2:
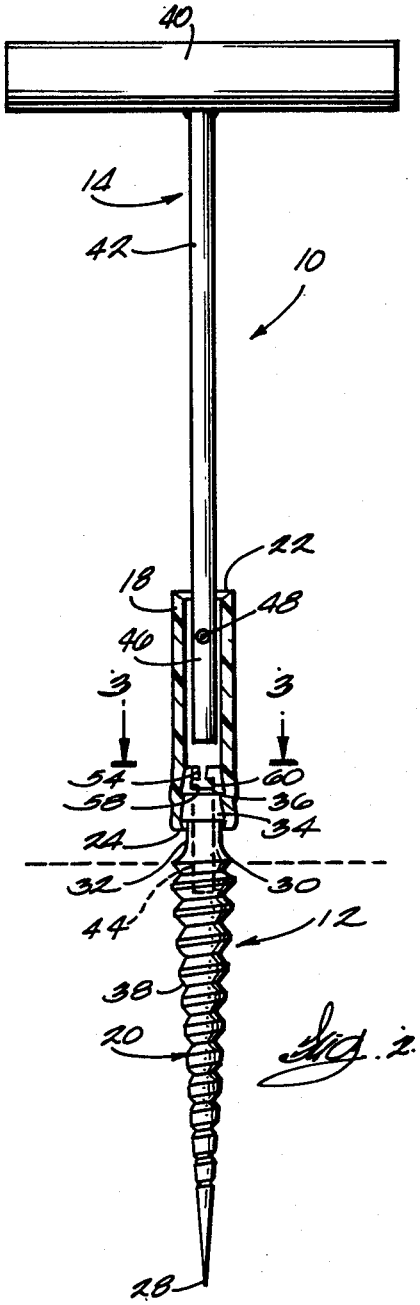
FIG. 2 is a side elevational view of the practice golf tee illustrated in FIG. 1, further showing a user-actuable handle for inserting and removing the practice golf tee.

Referring to the drawings, and, in particular, to FIG. 2, a practice golf tee system 10 constructed in accordance with the invention is illustrated. As illustrated, the golf tee system 10 generally includes a practice golf tee 12 and a user-actuable handle 14 for inserting the golf tee 12 into, and removing the golf tee assembly from, the ground 16.

Figure 1:
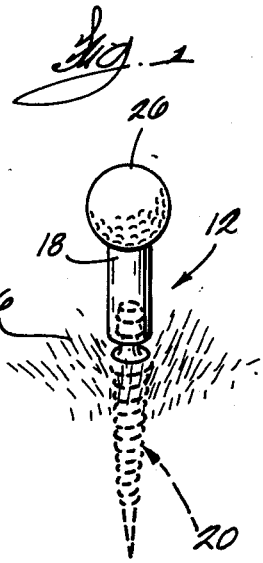
FIG. 1 is a perspective view of a practice golf tee constructed in accordance with the invention.

As best seen in FIGS. 1 and 2, the golf tee 12 includes an upper section comprising an elongate tubular member 18 formed of a flexible material, such as natural or synthetic rubber, and a lower section or anchor member 20 for supporting the elongate tubular member 18 in substantially perpendicular orientation relative to the ground 16. Preferably, the tubular member 18 is cylindrical in form and includes a pair of opposed, upper and lower ends 22 and 24. Preferably, the upper end 22 of the tubular member is inwardly beveled, as best seen in FIG. 2, so as to facilitate the support of a golf ball 26 thereon when the golf tee 12 is inserted in the ground 16.

Figure 3:
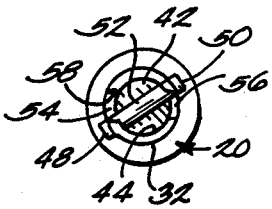
FIG. 3 is a cross-sectional view of the practice golf tee shown in FIG. 2, taken along line 3—3 thereof.

Referring further to FIGS. 1, 2 and 3, the anchor member 20 is preferably formed of a rigid, durable material, such as metal or molded plastic, and tapers from a pointed lower end 28 of minimum diameter to an upper end 30 of maximum diameter. Adjacent the upper end 30, the anchor member 20 includes an upwardly extending, generally cylindrical extension 32 dimensioned to be received within the open lower end 29 of the tubular member 18. Preferably, the extension 32 is adapted to resist separating movement between the tubular member 18 and the anchor member 20. In the embodiment illustrated, the extension 32 is provided with a pair of vertically stacked, frusto-conically shaped, serrations 34 and 36 which are dimensioned to distend the lower end 24 of the tubular member 18 slightly and thereby provide a secure friction fit between the tubular member 18 and the anchor member 20. It will be appreciated that, when desired, the tubular member 18 can be separated from the anchor member 20 so as to permit replacement of the tubular member 18 if the tubular member becomes worn after continued use.

To provide a secure anchor for the tubular member 18, the anchor member 20 is configured so as to resist withdrawal from the ground 16 during practice drives. To this end, the anchor member 20 is provided with a coarse external thread 38 along the below-ground portion of its length. By twisting the anchor member 20 in one direction, the external thread 38 functions to drive the anchor member 20 downwardly into the ground. The sharp point at the lower end 28 of the anchor member 20 facilitates such insertion into the ground 16. By rotating the anchor member 20 in the opposite section, the anchor member 20 can be removed from the ground 16 at the end of the practice session. During use, the coarse external thread 38 opposes direct upward withdrawal of the anchor member 20 and thereby helps to securely retain the tubular member 18 in position above the ground 16 as illustrated in FIG. 1.

To facilitate installation and withdrawal of the anchor member 20, the user-actuable handle 14 is adapted to permit the selective application of torque on the anchor member 20 as necessary to drive the anchor member 20 into or out of the ground 16. To this end, the handle 14 is substantially T-shaped in form and includes a horizontal graspable portion 40 and a downwardly depending stem portion 42 extending substantially perpendicularly outwardly from the graspable portion. To permit selective insertion or withdrawal of the golf tee 12, the handle 14 and anchor member 20 are arranged so that the handle 14 can be detachably engaged with the anchor member 20. To this end, the upper end 30 of the anchor member 20 is provided with an axially extending recess 44 dimensioned to receive the lower end 46 of the handle stem portion 42, and the lower end 46 of the handle stem portion 42 is provided with a pair of co-linearly aligned, radially outwardly extending pins 48 and 50 (FIG. 3). Preferably, the pins 48 and 50 are formed by means of a single cylindrical pin 52 mounted within a bore extending diametrically through the lower end 46 of the stem 42 and dimensioned to project beyond the stem at both ends.

To permit selective application of torque to the anchor members 20 so as to rotate the anchor member 20 in either direction, the uppermost end of the anchor member 20 is provided with a pair of L-shaped slots 54 and 56 extending through the sidewalls of the anchor member 20 and into the recess 44. The L-shaped slots 54 and 56 are located so that with said anchor preventing relative movement between said anchor and said handle means each slot receives one of the pins 48 and 50 when the lower end 46 of the handle 14 is inserted into the recess 44. Additionally, the slots 54 and 56 are oriented such that when the handle 14 is turned in a direction tending to thread the anchor member 20 into the ground 16, each of the pins 48 and 50 bears against a lower corner 58 formed by the adjacent slot. This permits a downwardly directed force to be applied to the anchor member 20 in addition to a twisting force so as to facilitate insertion of the anchor member 20 into the ground 16. Similarly, during withdrawal of the anchor member 20, each of the pins 48 and 50 lodges against an upper corner 60 formed by the adjacent L-shaped slot with the effect that an upwardly directed force can be applied to the anchor member 20 in addition to a twisting force tending to unscrew the anchor member 20 from the ground. As further illustrated in FIG. 2, the lower end 46 of the handle stem 42 is dimensioned to pass through the interior of the tubular member 18 so that the tubular member 18 can remain in place on the anchor member 20 during insertion and withdrawal of the golf tee 12.

During use, the handle 14 is used to insert the golf tee 12 into the ground 16 to a point where the lower end 24 of the tubular member 18 is substantially coincident with the ground level. Once so positioned, the handle 14 can be removed, and the practice tee 12 is now ready for use. With this arrangement, the golfer can practice as he would at a driving range having an artificial turf mat and can repeatedly place golf balls 26 on the free or upper end 22 of the flexible tubular member 18. The threads 38 maintain the anchor member 20 securely in the ground 16 and there is no need to repeatedly insert tees. After the practice session is over, the handle 14 can be reinserted into the recess 44 and slots 54 and 56 for removal of the practice tee 12.

Figure 4:
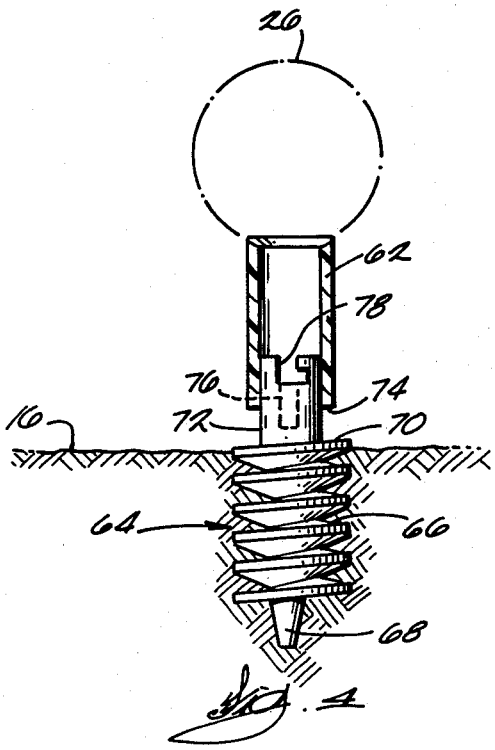
FIG. 4 is a side elevational view, partially in section, of an alternative embodiment of a practice golf tee.

An alternative embodiment of the invention is illustrated in FIG. 4. In this embodiment, the tubular member 62 is similar or identical to the tubular member 18 used in the embodiment shown in FIGS. 1 through 3. However, the anchor member 64 is generally cylindrical in form and includes a deep-fin exterior thread 66. Preferably, the anchor member 64 of the alternative embodiment is also formed of a rigid durable material such as metal or molded plastic, and includes a pointed lower end 68 for facilitating insertion of the anchor member into the ground 16. Because of the substantial withdrawal resistance provided by the deep-fin thread 66, the anchor member 64 of the alternative embodiment can be made shorter in length than the anchor member 20 of the embodiment illustrated in FIGS. 1 through 3 without significantly adversely affecting the ability of the anchor member 64 to resist inadvertent withdrawal from the ground 16 during use. Preferably, the upper end 70 of the anchor member 64 of the alternative embodiment includes an upwardly extending extension 72 dimensioned to be received within the open lower end 74 of the tubular member 62. Additionally, the upper extension includes a recess 76 and a pair of L-shaped slots 78 for receiving the lower end 46 of the handle 14. The recess 76 and slots 78 of the alternative embodiment function in substantially the same way as the recess 44 and slots 54 and 56 of the embodiment shown in FIGS. 1 through 3 to permit downwardly directed and upwardly directed twisting forces to be applied to the anchor member 64 as desired to facilitate insertion and withdrawal of the anchor member 64 relative to the ground 16.

As can be seen from the foregoing description, this invention provides a practice tee 12 which provides the convenience of tees usually associated with artifical turf practice mats. However, the invention also permits use in the grassy area of a driving range so that, during practice, a golfer experiences the footing ordinarily encountered on an actual golf course.

While a particular embodiment of the invention has been shown and described, it will be obvious to those skilled in the art that changes and modifications may be made therein without departing from the invention in its broader aspects, and, therefore, the aim in the appended claims is to cover all such changes and modifications as fall within the true spirit and scope of the invention.

We claim:

1. A practice golf tee as part of a practice golf tee system comprising:

an elongate, flexible, tubular member having opposite open ends;

an elongate anchor having a generally pointed lower end adapted to be inserted into and retained in the ground and having an upper end;

retaining means adjacent said upper end of said anchor connecting said anchor to one end of said tubular member for resisting separating movement of said tubular member relative to said anchor, said upper end of said anchor being exposed to the interior of said tubular member for access by a tool to be engaged with said upper anchor end through said tubular member for insertion of said anchor into the ground, and an elongated handle means as part of said system, said practice golf tee and handle means further characterized in that the upper end of said anchor has a preselected shape and said anchor is externally threaded intermediate its upper and cover ends, and said handle means having an end thereof of preselected shape corresponding to the preselected shape of said upper anchor end for selective rigid engagement with said anchor preventing relative movement between said anchor and said handle means so that said handle means is detachably engageable with said anchor for applying a rotational force to said anchor to insert said anchor into the ground.

2. A practice golf tee in accordance with claim 18 wherein said upper end includes an extension received in one of said open ends of said tubular member and wherein said retaining means comprises a plurality of serrations on said extension.

3. A practice golf tee in accordance with claim 1 wherein said anchor means has a generally uniform diameter up to said pointed end.

4. A practice golf tee in accordance with claim 3 wherein said anchor is tapered from an area of minimum diameter adjacent said lower pointed end to an area of maximum diameter adjacent said upper end.

5. A practice golf tee comprising:

an elongate, flexible, tubular member having a preselected transverse inner diameter and opposite open ends, an elongate anchor having a lower end adapted to be inserted into and retained in the ground and having an upper end attached to one of said open ends of said tubular member, retaining means adjacent said upper end of said anchor for resisting separating movement of said tubular member relative to said anchor, said anchor including an exterior thread intermediate said ends configured to drive said anchor into the ground in response to rotation of said anchor in one direction, and to drive said anchor out of the ground in response to rotation of said anchor in the opposite direction and to resist withdrawal of said anchor from the ground except when said anchor is rotated in said other direction, said anchor being tapered from an area of minimum diameter at said lower end to an area of maximum diameter adjacent said upper end, and means including an elongated shaft having a transverse outer diamter less than said diameter of said tubular member an outwardly extending transverse pin adjacent one of its ends and a handle attached at its other end, said anchor further includes a generally L-shaped slot dimensioned to releasably receive said pin so that said handle means can apply downwardly directed force to said anchor when said handle means is rotated in said one direction and can apply upwardly directed force to said anchor when said handle means is rotated in said other direction.

6. A practice golf tee system comprising:

a segment of hollow flexible tubing having a pair of spaced open ends;

an elongate externally threaded anchor member adapted to be inserted into the ground by being rotated in one driection and removed from the ground by being rotated in the opposite direction and having an upper end attached to one of said ends of said flexible tubing segment;

An elongated user-actuable handle having an end adapted to extend longitudinal through said flexible tubing segment and detachably engage said anchor member so as to permit selective user-rotation of said anchor member in either said one direction or said opposite direction, said handle and said anchor member being arranged so that said handle can apply a downwardly directed force on said anchor member when said handle and said anchor member are rotated in said one direction, and so that said handle can apply an upwardly directed force to said anchor member when said handle and said anchor member are rotated in said opposite direction, and said end of said handle having a substantially radially outwardly extending pin and wherein said anchor member includes a recess for receiving said lower end of said handle and further includes a substantially L-shaped slot communicating with said recess for releasably lockingly receiving said radially outwardly extending pin.

7. A practice golf tee system in accordance with claim 6 wherein said lower end of said handle includes a pair of said outwardly extending pins and said anchor member includes a pair of said L shaped slots for receiving each of said pins.

8. A practice golf tee system in accordance with claim 7 wherein said anchor member is tapered and includes a lower end of relatively narrower diameter and an upper end of relatively greater diameter.

9. A practice golf tee system in accordance with claim 8 wherein said anchor member is formed of metal.

10. A practice golf tee system in accordance with claim 7 wherein said anchor member is of substantially constant diameter along its length.

11. A practice golf tee system in accordance with claim 10 wherein said anchor member is formed of molded plastic.

12. A practice tee in accordance with claim 7 wherein said anchor member has a generally uniform outer diameter and terminates in a pointed end for insertion into the ground.

* * * * *

UNITED STATES PATENT AND TRADEMARK OFFICE

CERTIFICATE OF CORRECTION

PATENT NO. : 4,905,999

DATED : March 6, 1990

INVENTOR(S) : Steven M. Voinovich, Michael J. Messina

It is certified that error appears in the above-identified patent and that said Letters Patent is hereby corrected as shown below:

Column 5, line 18, "cover" should read --lower--.

Column 5, line 28, "18" should read --1--.

line 63, "diamter" should read --diameter--;

Column 6, line 4, after "slot" insert --at said upper end--;

line 5, after "pin" insert --upon insertion of said transverse pin and said one end of said shaft longitudinally into said tubular member--;

line 5, delete "said handle means can apply" and insert --a rotating--;

UNITED STATES PATENT AND TRADEMARK OFFICE

CERTIFICATE OF CORRECTION

PATENT NO. : 4,905,999

DATED : March 6, 1990

INVENTOR(S) : Steven M. Voinovich, Michael J. Messina

It is certified that error appears in the above-identified patent and that said Letters Patent is hereby corrected as shown below:

Column 6:

line 6, after "force" insert --applied--;

lines 6-10, delete "anchor when said handle...other direction" and insert --handle will cause said anchor to be driven into the ground when rotated in said one direction and rotation of said handle in said opposite direction will cause said anchor to be extracted from the ground--.

Signed and Sealed this

Thirtieth Day of July, 1991

*Attest:*

*Attesting Officer*

HARRY F. MANBECK, JR.

*Commissioner of Patents and Trademarks*